United States Patent [19]

Iwamoto et al.

[11] Patent Number: 4,932,458

[45] Date of Patent: Jun. 12, 1990

[54] METHOD OF AND SYSTEM FOR OPERATING SQUEEZE PLUNGER IN DIE CAST MACHINE

[75] Inventors: Norihiro Iwamoto; Hiroyuki Tsuboi; Toshihiko Kaneko, all of Zama, Japan

[73] Assignee: Toshiba Machine Co., Ltd., Tokyo, Japan

[21] Appl. No.: 301,153

[22] Filed: Jan. 25, 1989

[30] Foreign Application Priority Data

Jan. 30, 1988 [JP] Japan ..... 63-11657[U]

[51] Int. Cl.[5] ..... B22D 18/02

[52] U.S. Cl. ..... 164/4.1; 164/120; 164/154

[58] Field of Search ..... 164/4.1, 120, 150, 154, 164/319, 320, 321, 457

[56] References Cited

U.S. PATENT DOCUMENTS 4,380,261 4/1983 Suzuki et al. ..... 164/120

*Primary Examiner*—Richard K. Seidel

*Attorney, Agent, or Firm*—Cushman, Darby & Cushman

[57] ABSTRACT

A method of and a system for operating a squeeze plunger in a die cast machine. When the fill-up of molten metal in a cavity is completed by an injection plunger, the moving speed of the injection plunger is rapidly decreased. When the speed at this time becomes lower than a preset value, a preset delay time is measured. After a lapse of this delay time, the squeeze plunger is operated to press a molding material in the cavity, so that plastic flows are caused in the molding material.

7 Claims, 2 Drawing Sheets

METHOD OF AND SYSTEM FOR OPERATING SQUEEZE PLUNGER IN DIE CAST MACHINE

BACKGROUND OF THE INVENTION

1. Field of the Invention

This invention relates to a method of and a system for operating a squeeze plunger in a die cast machine for improving the quality of a die cast product.

2. Description of the Related Art

With a die cast machine, there has heretofore been adopted such a technique that, after a cavity of a mold is filled up with a molten metal, the interior of the cavity is pressed by means of a squeeze plunger device, thereby causing plastic flows in a molding material.

A known injection unit in a die cast machine provided with a squeeze plunger device is shown in FIG. 3 for example. This injection unit 1 includes an injection plunger 4 connected to a piston rod 3 of an injection cylinder 2, and arranged to permit the injection plunger to perform moving strokes in two stages including a low speed injection region $S_l$ and a high speed injection region $S_h$ in an injection sleeve 6 of a mold assembly 5.

Fixed onto the piston rod 3 is a dog 7, in the vicinity of which is disposed a limit switch 8. A positional relationship between the dog 7 and the limit switch 8 is detected so as to detect a position of stroke of the injection plunger 4, whereby a timer, not shown, is actuated to operate the squeeze plunger.

However, the conventional system suffers from the following problems.

That is, adjustment of the positional relationship between the dog 7 and the limit switch 8 to detect the position of stroke of the injection plunger 4 is very delicate, so that a considerably high skill level is required for the accurate adjustment. Furthermore, adjustment of the timing to operate the squeeze plunger depends upon the detection of the position of stroke of the injection cylinder 4, whereby the squeeze plunger is operated regardless of the actual state how a molten metal is filled and the like, so that improvements in the quality of a die cast product cannot necessarily be achieved. Moreover, in the conventional system, the state where the molten metal is filed up completely is uniformly and presumably grasped on the basis of positional relationship between the dog 7 and the limit switch 8, and the actual state of the filled-up molten metal is not fed back, so that it is very difficult to cope with the changes in the various conditions of molding, and the like.

SUMMARY OF THE INVENTION

The present invention has been developed on the basis of the problem about that adjustment of the timing of operation of the squeeze plunger is depended upon detection of the position of the injection plunger in the conventional system, and has as its object the provision of a method of and a system for operating a squeeze plunger in a die cast machine, wherein the state of the filled-up molten metal in the cavity is more directly and with high accuracy grasped by detecting the moving speed of the injection plunger, whereby the squeeze plunger is operated at the optimum timing, so that a die cast product high in the quality can be obtained.

To achieve the above-described object, the method of operating the squeeze plunger in the die cast machine according to the present invention features that, in filling the molten metal in a mold cavity by the driving of the injection plunger of the die cast machine, a time, at which the speed of the injection plunger is rapidly decreased to a speed lower than a preset value, is detected by the actual measuring, and, after a lapse of a preset delay time upon detecting the aforesaid time, the squeeze plunger is operated.

The system for operating the squeeze plunger in the die cast machine according to the present invention features that the system includes: an injection unit having an injection cylinder and an injection plunger being linearly movable relative to a mold assembly by the driving of the injection cylinder; and a squeeze plunger device being linearly movable relative to a cavity of the mold assembly after a molten metal is filled up in the cavity; wherein the squeeze plunger device is driven after a lapse of a preset delay time upon decreasing of the moving speed of the injection plunger to a speed lower than a preset value.

According to the present invention, the position of stroke of the injection plunger is turned into the moving speed without detecting the position of the injection plunger. Upon completion of the fill-up of the molten metal in the cavity, the moving speed of the injection plunger is rapidly decreased. When this speed is decreased to a speed lower than the speed preset in association with the conditions of molding and the like and detected, the squeeze plunger is operated after a lapse of a predetermined time, whereby the forward end of the squeeze plunger presses the interior of the cavity, so that plastic flows of the molding material can be caused in the cavity.

DETAILED DESCRIPTION OF THE PREFERRED EMBODIMENT

Figure 1:
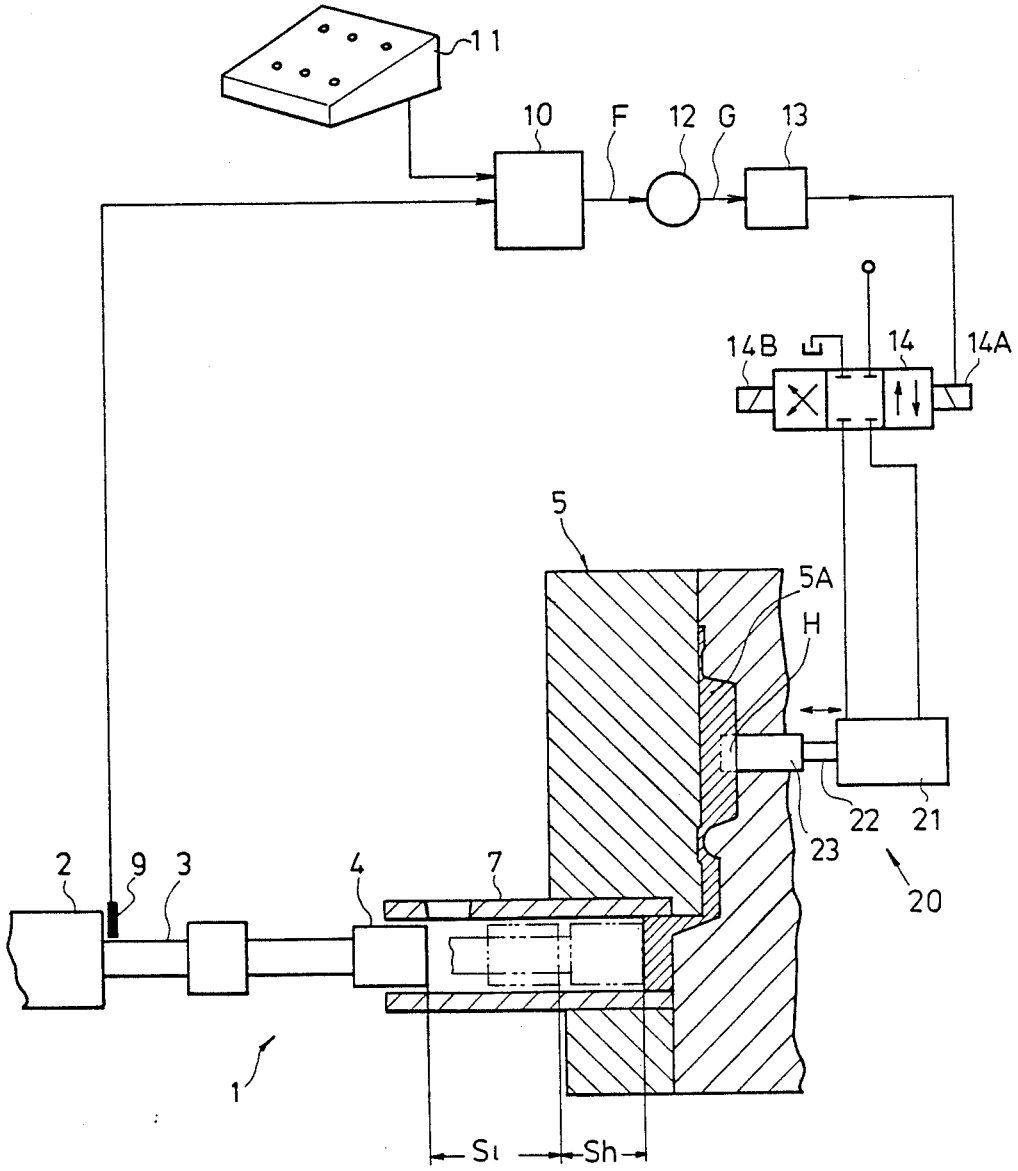
FIG. 1 is a schematic block diagram showing the general arrangement of an embodiment according to the present invention.

One embodiment of the present invention will hereunder be described with reference to the accompanying drawings. In the description of this embodiment, same reference numerals are used to designate same or similar components corresponding to ones as shown in the conventional system, so that the description will be omitted or simplified.

FIG. 1 shows a schematic arrangement in which an injection unit 1 of a cold chamber die cast machine according to this embodiment is combined with a squeeze plunger device 20. Referring to the drawing, a linear encoder 9 as being a detecting means is disposed at one side of a piston rod 3. This linear encoder 9 is adapted to detect a moving stroke of the piston rod 3, and in turn, a moving stroke of an injection plunger 4. An output of the linear encoder 9 is delivered to a solenoid constituting a part of hydraulic circuit, not shown, of an injection cylinder device 2, and due to the operation of this solenoid, switching of the moving speeds of the injection plunger 4 between a low speed injection region $S_l$ and a high speed injection region $S_h$.

The output from the linear encoder 9 is simultaneously delivered to a controller 10. This controller 10 receives a pulse signal from the linear encoder 9 as an input, and has a function of calculating a stroke of the injection plunger 4 and outputting the result and another function of calculating a speed of the injection plunger 4 and outputting the result. Connected to this controller 10 is an input unit 11, through which a preset value $V_s$ is input when the speed of the injection plunger is rapidly decreased to a speed lower than the preset value and actually measured.

The controller 10 is adapted to detect that the speed of the injection plunger 4 is decreased to a speed lower than the preset value $V_s$ and deliver a fill-up completion signal F to a squeeze delay timer 12. This squeeze delay timer 12 is adapted to measure a preset delay time from a time, at which the fill-up completion signal F is input. On condition that the preset delay time (referred to briefly as a "preset time") Td elapses, the squeeze operation start signal G to a relay 13, whose output signal excites a solenoid valve 14 to drive the squeeze plunger device 20.

The squeeze plunger device 20 includes a hydraulic cylinder 21 and a squeeze plunger 23 provided on a piston rod 22 of this hydraulic cylinder 21. This squeeze plunger 23 is made linearly movable relative to a mold cavity 5A by the operation of the solenoid valve 14, so that the mold cavity 5A can be pressed to cause plastic flows of the molding material after the molten metal is filled up.

Figure 2:
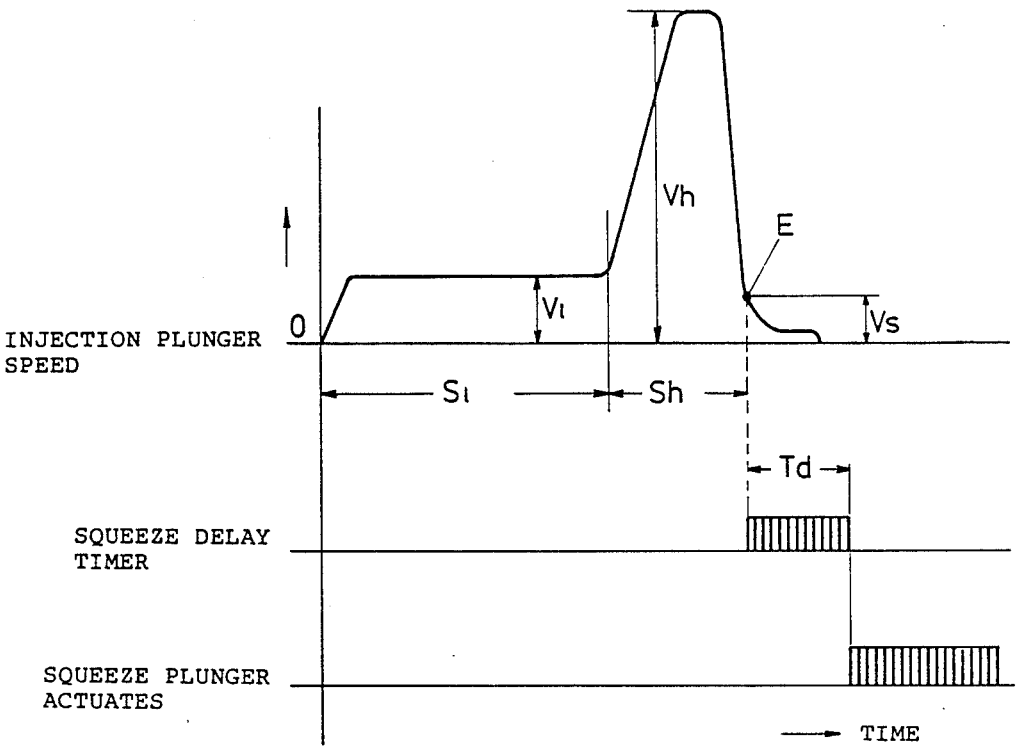
FIG. 2 is a chart of speeds and motions, showing the action of the embodiment.
Figure 3:
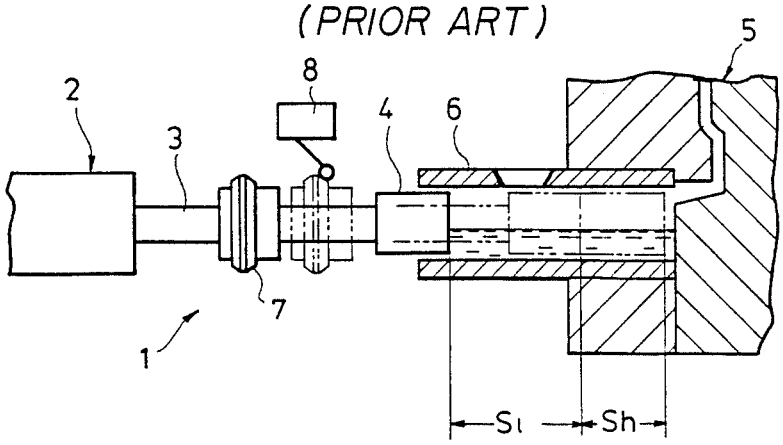
FIG. 3 (PRIOR ART)
FIG. 3 is a schematic block diagram showing the conventional system.

Action of this embodiment will hereunder be described with reference to FIG. 2.

Prior to the driving of the injection unit 1 of the die cast machine, the preset value $V_s$ is input through the input unit 11, and simultaneously, the preset time Td to actuate the squeeze plunger 23 is set.

Now, when the injection cylinder device 2 is driven to advance at a speed $V_1$ in the low speed injection region $S_1$ and reaches the high speed injection region $S_h$, the injection cylinder device rapidly advances at a speed $V_h$, so that the molten metal is filled up in the mold cavity 5A. When this fill-up is completed and the speed of the injection plunger 4 is rapidly decreased to reach a point E, since $V_s$ is input as a preset value through the input unit 11, the controller 10 detects the decreased speed $V_s$ to output the fill-up completion signal F.

Subsequently, when the squeeze delay timer 12 is actuated to reach the preset time $T_d$, the squeeze operation start signal G is emitted. Then, the relay 12 is actuated to excite a solenoid 14A of the solenoid valve 14, whereby the piston rod 22 and the squeeze plunger 23 of the hydraulic cylinder 21 advance, and the squeeze plunger 23 projects into a die cast product being in a half-solidified state in the cavity 5A as indicated by a dotted line in FIG. 1, so that the plastic flows can be caused, i.e. a so-called squeezing effect can be achieved.

After the squeeze plunger 23 presses the interior of the cavity 5A for a predetermined period of time as described above, a solenoid 14B is excited to retract the squeeze plunger 23.

The above-described embodiment can offer the following advantages.

Namely, in this embodiment, because the fact that the speed of the injection plunger 4 is decreased to a speed lower than the preset value $V_s$ is detected so as to grasp the state how the molten metal is filled in the mold cavity 5A, the accuracy in this embodiment is higher than that in the conventional system in which the state of the filled-up molten metal is grasped by detecting the positional relationship between the dog 7 and the limit switch 8, the delicate adjusting works required of the conventional system can be eliminated, and the squeeze plunger can be operated to cope with changes of various molding conditions and the like, so that the die cast products high in the quality can be molded.

Moreover, the preset value $V_s$ and the preset time $T_d$ may be varied in various fashions, so that the method of operating of the squeeze plunger according to this embodiment can be advantageously applied to wide use.

The system for working the method of operating of the squeeze plunger can be constructed by use of the known components and parts, so that high installation costs can be avoided.

In the above embodiment, the limit switch 9 is described as the linear encoder, however, the present invention need not necessarily be limited to this, and any other detection device which can detect the position of stroke of the piston rod 3 and in turn the injection plunger 4 may be adopted.

The preset value $V_s$ and the preset time $T_d$ are not fixed values and variable input values, so that the optimum values can be selected depending on the die cast product to be molded.

The present invention is applicable not only the cold chamber die cast machine, but also a hot chamber die cast machine.

As has been described hereinabove, the present invention can offer the advantage that, without resorting to adjustment of the limit switch and the like, the speed of the injection plunger is detected through the actual injection, thereby operating the squeeze plunger at the optimum timing.

What is claimed is:

1. A method of operating a squeeze plunger in a die cast machine, comprising:

driving an injection plunger of the die cast machine to fill a mold cavity with a molten metal;

detecting a moving stroke of said injection plunger and calculating the speed of said injection plunger;

detecting a decrease in speed of said injection plunger which is lower than a preset value; and operating said squeeze plunger after a preset delay time following detecting said decrease.

2. A method of operating a squeeze plunger as set forth in claim 1, wherein said preset value and said delay time are made variable in association with the conditions of molding.

3. A method of operating a squeeze plunger as set forth in claim 1, wherein said delay time is measured by a squeeze delay timer and a signal for actuating said timer is given when the speed of said plunger becomes lower than the preset value.

4. A system for operating a squeeze plunger in a die cast machine comprising:

an injection unit having an injection cylinder and an injection plunger linearly movable relative to a mold assembly by driving said injection plunger, means for detecting a moving stroke of said injection plunger and controller means for receiving an output from said detecting means and for calculating the speed of said injection plunger;

a squeeze plunger device linearly movable relative to a cavity of said mold assembly after a molten metal has filled the cavity; and means responsive to said controller for driving said squeeze plunger device after a lapse of a preset delay time after a moving speed of said injection plunger decreases to less than a preset value.

5. A system for operating a squeeze plunger as set forth in claim 4, wherein, connected to said controller is an input means, through which said preset value and said delay time are input 6. A system for operating a squeeze plunger as set forth in claim 5, wherein said delay time is measured by a timer connected to said controller and a signal to start the measuring of said delay time is given to said timer when the speed of said injection plunger becomes lower than said preset value.

7. A system for operating a squeeze plunger as set forth in claim 4, wherein said preset value and said delay time are made variable in association with the conditions of molding.

* * * * *